US007857160B2

(12) United States Patent
Owensby

(10) Patent No.: US 7,857,160 B2
(45) Date of Patent: Dec. 28, 2010

(54) OPTIMIZED TRAY FOR CASE-READY MEAT

(75) Inventor: Joseph E. Owensby, Spartanburg, SC (US)

(73) Assignee: Sealed Air Corporation, Saddle Brook, NJ (US)

( * ) Notice: Subject to any disclaimer, the term of this patent is extended or adjusted under 35 U.S.C. 154(b) by 1206 days.

(21) Appl. No.: 10/857,268

(22) Filed: May 28, 2004

(65) Prior Publication Data

US 2005/0263530 A1 Dec. 1, 2005

(51) Int. Cl.
*B65D 6/00* (2006.01)
*B65D 8/04* (2006.01)
*B65D 8/18* (2006.01)

(52) U.S. Cl. ..... 220/675; 220/669

(58) Field of Classification Search ..... 220/669, 220/670, 671, 673, 675, 573
See application file for complete search history.

(56) References Cited

U.S. PATENT DOCUMENTS

| | | | | |
|---|---|---|---|---|
| 2,296,808 | A | 9/1942 | Chaplin | |
| 2,738,915 | A * | 3/1956 | St Clair Truman | 229/406 |
| 3,250,429 | A * | 5/1966 | Gesell | 220/675 |
| 3,642,162 | A | 2/1972 | Doman et al. | |
| 3,858,786 | A * | 1/1975 | Vogt | 220/574 |
| 4,058,247 | A | 11/1977 | Florian | |
| D249,233 | S | 9/1978 | Florian | |
| 4,856,704 | A | 8/1989 | Tolson et al. | |
| D360,808 | S | 8/1995 | Meier et al. | |
| D378,734 | S | 4/1997 | Hardy et al. | |
| 2003/0108643 | A1 | 6/2003 | Hornsby et al. | |

FOREIGN PATENT DOCUMENTS

| | | |
|---|---|---|
| EP | 0 890 517 A2 | 1/1999 |
| WO | 03/034830 A1 | 5/2003 |

* cited by examiner

*Primary Examiner*—Anthony Stashick
*Assistant Examiner*—Shawn M Braden
(74) *Attorney, Agent, or Firm*—Alston & Bird LLP

(57) ABSTRACT

An optimized tray for case-ready meat products is disclosed. The tray comprises a base, a plurality of sidewalls connected at a plurality of corners, a flange extending from an upper edge of each sidewall, and a plurality of substantially vertical ribs extending from said sidewalls and spaced apart thereal-ong. At least one of the sidewalls is bowed inwardly, and the flange along at least a partial length of the at least one bowed sidewall is varied in width. The ribs can also vary in thickness along at least a partial length of at least one of the sidewalls. The interaction of the at least one bowed sidewall, the varying flange width, and the varying rib thickness allows for optimization of tray resistance to vertical and horizontal stress without increasing the overall outer dimensions of the tray and without substantially decreasing the internal volume of the tray.

57 Claims, 4 Drawing Sheets

OPTIMIZED TRAY FOR CASE-READY MEAT

BACKGROUND

The present invention relates to a tray used in case-ready packaging that has an optimized geometry. More particularly, the present invention relates to a tray for use in packaging case-ready meat products, wherein the tray has improved sidewall stiffness, particularly resisting horizontal stress, without increasing overall outside dimensions or substantially decreasing overall internal volume.

Historically, fresh meat products available to consumers have been substantially prepared for end-use at the site of final sale. For example, in the area of beef products, unfinished slabs, or portions of slabs, of beef are delivered refrigerated to a retail grocer or butcher where particular cuts of beef are prepared for final sale. This has generally provided a sense of assurance to a customer that the meat product being purchased is of the freshest possible quality. Advances in packing technology and increased consumer demand, however, have led to an increase in the volume of case-ready meat products available to consumers.

Case-ready meat can be generally defined as fresh meat that is prepackaged and/or prelabeled at a centralized location and delivered to the retail market prepared for final sale. According to a 2002 study by Cryovac and the National Cattleman's Beef Association, more than half of the ground beef and more than 80% of the turkey and chicken products delivered to U.S. domestic supermarkets for retail sale are delivered in case-ready packaging. For many supermarkets, especially so-called "mega grocery stores," case-ready meat products provide not only cost savings in terms of minimizing on-site butchering and packaging, but also increased sanitation and decreased incidence of product spoilage.

To meet the increasing demand for case-ready meat products, many meat producers have moved to specified weight and/or volume packaging of common meat products, such as chicken breast and ground beef. Accordingly, there is an increasing need for packaging supplies for products of predetermined size and volume, particularly packaging trays.

Trays for use in case-ready meat packaging must meet various specifications. In terms of product quality management, trays must be of a standard size that provides a sufficient internal volume to contain the specified weight or volume of meat product and also a specified volume of gases, such as oxygen and carbon dioxide, to provide a desirable gas to product volume ratio. Such gases in precise amounts are used to preserve freshness of the meat product during shipping, to prolong shelf life at the retail site, and to improve product appearance. In particular, oxygen is used to impart the familiar red color to beef products that consumers generally associate with freshness and thus find desirable.

While it is beneficial to have sufficient internal volume, excess volume is undesirable as it correlates to increased outer dimensions that negatively impact shipping costs and lead to reduced availability of shelf space. Tray size needs to be minimized so that the desired weight or volume of meat product can be shipped with as many trays per shipping carton as possible. Unnecessarily large tray size, therefore, increases shipping costs. Further, unnecessarily large tray size reduces the number of packages that can be displayed in a given display case at the retail site.

Tray strength is also a concern for case-ready products. Trays filled with a meat product are often shipped stacked several trays high. Thus, a tray must be resistant to buckling under a vertical load. Further, a tray for case-ready meat products must be resistant to horizontal pressure, such as that imparted by the film overwrap often used to cover the open top of the tray. Generally, the film is stretched across the top of the tray and sealed around the upper edges of the tray.

Minimizing tray dimensions and maximizing tray strength tend to be mutually exclusive goals. For example, one approach to minimizing tray dimensions, thus reducing shipping costs and increasing shelf space, is to reduce the width of the flange that is typically provided on the upper edge of trays. However, experience has shown that if flange width is appreciably decreased, the final packaging can be excessively distorted by the tension of the overwrap film deflecting the sidewalls of the tray inward, making the package appearance unacceptable, or leading to tray integrity failure. Alternatively, increasing flange width can increase resistance of the final package to sidewall deflection, but such added strength comes at the cost of increased external package dimensions, increasing shipping costs and reducing available shelf space.

Accordingly, there remains a need in the art for a tray for case-ready meat products having an optimized geometry. Such an optimized geometry would ideally enable production of a tray of a standardized size with maximized resistance of the tray to vertical and horizontal stress without increased external dimensions. Further, such a tray would maintain the necessary internal volume for containing both a meat product and a necessary amount of beneficial gasses. A tray meeting these criteria is provided by the present invention.

SUMMARY OF THE INVENTION

According to one embodiment of the present invention, there is provided a tray for case-ready meat products, wherein the tray comprises a plurality of sidewalls connected to a base and interconnected at a plurality of corners. The sidewalls have a top edge with a flange extending therefrom and an inner surface with a plurality of substantially vertical ribs formed therein and spaced apart therealong and extending therefrom. At least one of the sidewalls is bowed inwardly toward an interior portion of the tray. In coordination with said bowed portion of the sidewalls, the flange width is increased, thus providing increased horizontal stress resistance. The flange has an outer edge that is substantially linear between the respective corners at opposite ends of the sidewall.

In a preferred embodiment, the sidewall is bowed and the corresponding flange width is increased such that the width of the flange is at a maximum at a midpoint of the sidewall and is at a minimum at the respective corners at opposite ends of the sidewall. Such a configuration provides increased sidewall strength with the increased flange width while not increasing the external dimension of the tray, the outer edge of the flange remaining substantially linear between the respective corners at the opposite ends of the sidewall.

In one variation of this embodiment, the ribs spaced apart along the sidewalls extend inwardly toward an interior of the tray by a distance that is substantially constant along the length of the sidewalls. In this embodiment, the internal volume of the tray is minimally reduced.

In another variation of this embodiment, the distance the ribs extend inwardly varies along at least a partial length of at least one of the sidewalls. In one particularly preferred embodiment, the distance the ribs extend is at a maximum at an area of at least one of the sidewalls near its respective corners and is at a minimum at an area of the at least one sidewall that is approximately a midpoint between the corners. The distance can be gradually reduced moving away from the corners and toward the midpoint. Alternately, the ribs can be present at the areas near the corners and be totally absent near the midpoint.

In another embodiment of the invention, the tray is comprised of a sheet of polymer material shaped to form a generally rectangular base having four integrally connected sidewalls extending upwardly from an outer periphery thereof. The sidewalls comprise two opposite generally parallel longitudinal walls and two opposite generally parallel end walls, each of the four walls being integrally joined at four corners of the tray. Each of the sidewalls has an upper edge and a flange integrally joined to the upper edges and extending outwardly therefrom having a free outer edge. The tray further comprises a plurality of substantially vertical ribs formed in at least a portion of at least each of the longitudinal walls, preferably in all four sidewalls, and spaced apart therealong.

According to this embodiment, each longitudinal wall has at least one partial lengthwise portion that is bowed inwardly toward an interior of the tray. Additionally, the flange has a varying width along each longitudinal wall, and the outer edge of the flange is substantially linear along the length of each longitudinal wall. It is particularly preferred, according to this embodiment, that the width of the flange be at a maximum at a midpoint of each longitudinal wall and at a minimum near the respective corners at opposite ends of each longitudinal wall.

Further according to this embodiment, the ribs spaced apart along each longitudinal wall extend inwardly toward an interior of the tray, extending a distance that is substantially constant along the length of the sidewalls. In this embodiment, the internal volume of the tray is minimally reduced.

In another variation of this embodiment, the distance the ribs extend inwardly varies along at least a partial length of each longitudinal wall. In one particularly preferred embodiment, the distance the ribs extend is at a maximum at an area of each longitudinal wall near its respective corners and is at a minimum at an area of each longitudinal wall that is approximately a midpoint. The distance can be gradually reduced moving away from the corners and toward the midpoint. Alternately, the ribs can be present at the areas near the corners and be totally absent near the midpoint.

According to another embodiment of the present invention, there is provided a tray comprising a generally rectangular base defining a bottom portion of the tray, four integrally connected sidewalls extending upward from an outer periphery of the base and integrally joined at four corners extending upward from the base, a flange integrally connected to, and extending outward from, an upper edge of the sidewalls, and a plurality of substantially vertical ribs formed in at least a portion of each sidewall and spaced apart therealong. According to this embodiment, at least one the sidewalls has a partial lengthwise portion that is bowed inwardly toward an interior of the tray. Preferably, two opposing sidewalls each have at least a partial lengthwise portion that is bowed inwardly. Preferentially, according to this embodiment, two of the sidewalls are opposite, generally parallel longitudinal walls, and the remaining two sidewalls are opposite, generally parallel end walls.

In yet another embodiment according to the present invention, there is provided a tray comprising a polymer sheet shaped to form a generally rectangular base and four integrally connected sidewalls upstanding from a periphery of the base, wherein the sidewalls comprise two opposite generally parallel longitudinal walls and two opposite generally parallel end walls that are integrally joined at four corners of the tray. Each of the sidewalls has an upper edge and a flange integrally joined to the upper edges of the sidewalls. The flange extends outwardly from the upper edges of the sidewalls and has a free edge. Each of the longitudinal walls has at least a partial lengthwise portion that is bowed inwardly toward an interior of the tray. Further, the flange attached to the upper edges of the sidewalls varies in width from a maximum at a midpoint of each longitudinal wall to a minimum at the respective corners at opposite ends of each longitudinal wall, and the outer edge of the flange is substantially linear along each longitudinal wall. The tray according to this embodiment further comprises a plurality of substantially vertical ribs formed in at least a portion of each of the sidewalls and spaced apart therealong, the ribs extending inwardly a distance from the sidewalls.

Further according to this embodiment, the distance the ribs spaced apart along at least a portion of each sidewall extend inwardly toward an interior of the tray can be substantially constant along the length of the sidewalls. In this embodiment, the internal volume of the tray is minimally reduced.

In another variation of this embodiment, the distance the ribs extend inwardly varies along at least a partial length of each sidewall. In one particularly preferred embodiment, the distance the ribs extend is at a maximum at an area of each sidewall near its respective corners and is at a minimum at an area of each sidewall that is approximately a midpoint. The distance can be gradually reduced moving away from the corners and toward the midpoint. Alternately, the ribs can be present at the areas near the corners and be totally absent near the midpoint.

Various alternatives of the above-described embodiments can also exist. For example, the width of the flange can be at a maximum at a single point on each longitudinal wall or at a plurality of points on each longitudinal wall. Similarly, the width of the flange can be at a maximum over a partial length of each longitudinal wall or over multiple partial lengths of each longitudinal wall.

Various alternatives can also exist with respect to the shape of the bowed portion of each longitudinal wall. For example, the bowed portion can be substantially arcuate in shape, being substantially curved along at least a partial length of each longitudinal wall. Alternatively, the bowed portion of each longitudinal wall can be substantially angularly shaped. For example, the bowed portion can be essentially two substantially linear portions that intersect to form an angle $\theta$. As each longitudinal wall can have a plurality of partial lengthwise portions that are bowed inwardly, each longitudinal wall can also have a plurality of substantially linear portions intersecting to form a plurality of angles. In another alternative embodiment, the bowed portion of each longitudinal wall can comprise three linear portions that intersect to form a first angle and a second angle, each angle being less than 180°.

DETAILED DESCRIPTION OF THE INVENTION

The present invention will now be described more fully hereinafter with reference to the accompanying drawings, in which some, but not all embodiments of the invention are shown. The present invention may be embodied in many different forms and should not be construed as limited to the embodiments set forth herein; rather, these embodiments are provided so that this disclosure will satisfy applicable legal requirements. Like numbers refer to like elements throughout.

Figure 1:
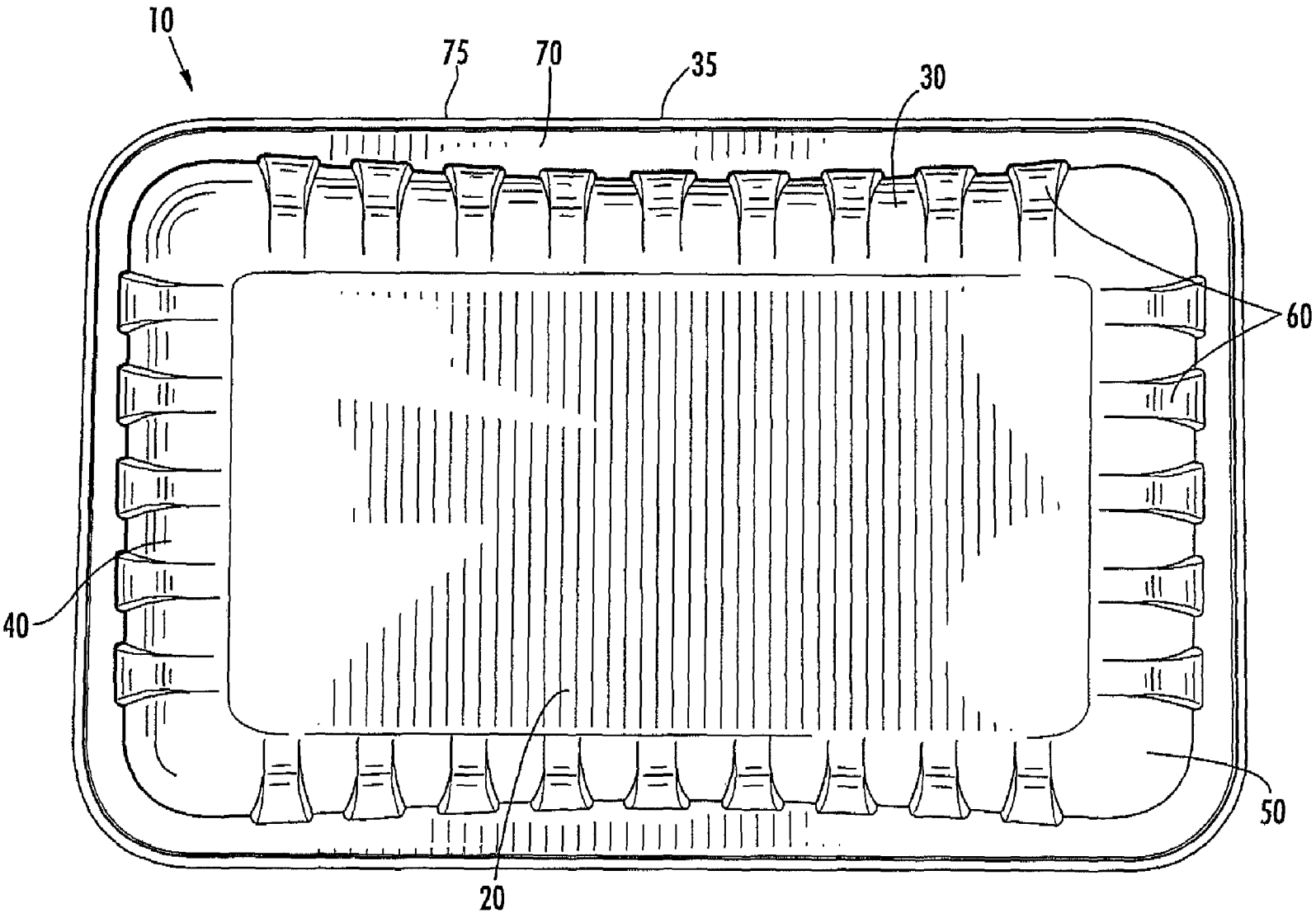
FIG. 1 is a top view of one embodiment of the tray of the present invention.

FIG. 1 illustrates a tray 10 for case-ready meat products generally according to the present invention. The tray 10 is comprised of a base 20 and four sidewalls. According to the embodiment shown in FIG. 1, the sidewalls are comprised of two longitudinal walls 30 that are generally parallel and situated opposite each other and two end walls 40 that are also generally parallel and situated opposite each other. The longitudinal walls 30 and end walls 40 are integrally joined at four corners 50, the tray 10 thus generally being rectangular in shape. The tray 10 according to the invention, however, is not limited to such shape. For example, each of the four sidewalls could be substantially identical in length forming essentially a square tray. Furthermore, the tray 10 could be comprised of a number of sidewalls other than the four shown in FIG. 1, provided there is at least a plurality of sidewalls.

The tray 10 of the present invention further comprises a series of ribs 60 formed in at least a portion of at least one of the sidewalls. Preferentially, the ribs 60 are substantially vertical, extending from the base 20 of the tray 10 to an upper edge of the sidewalls. The ribs 60 are useful for increasing the ability of the tray 10 to be resistant to vertical stress, such as that encountered in the stacking of trays loaded with product. In the embodiment shown in FIG. 1, the ribs 60 are present in each of the longitudinal walls 30 and each of the end walls 40 and spaced apart along a length of each of the longitudinal walls 30 and each of the end walls 40. In further embodiments of the invention, the ribs 60 may be present in only two sidewalls. In still further embodiments, the ribs 60 may be present in each of the sidewalls but only in the portions of the sidewalls that are substantially near the corners 50.

The presence of the ribs 60 is particularly advantageous because of the added resistance to vertical stress provided by the ribs 60, but the ribs 60 also take away a portion of the available internal volume of the tray 10. Each of the ribs 60 extend inwardly a distance from the inner surface of the sidewalls, this distance defining a thickness of the ribs. The thickness of the ribs 60 can therefore be adjusted to optimize sidewall strength and maximize internal volume of the tray 10. Accordingly, the thickness of the ribs 60 can vary up to a maximum of about 0.125 inches.

The tray 10 of the present invention further comprises a flange 70 that is integrally connected to, and extending outward from, the upper edge of the sidewalls. Preferentially, the flange 70 extends completely around the perimeter of the upper edge of the sidewalls and the corners 50. The flange 70 is substantially flat having an upper surface and a lower surface. Further, the flange 70 has a free outer edge 75 that defines a maximum outer dimension of the tray 10. The flange 70 has a width that is defined as a distance from the free outer edge 75 of the flange 70 to the inner surface of the sidewall. This distance can be measured along the upper surface of the flange 70. As noted above, the ribs 60 are vertically arranged, generally extending from the base 20 of the tray 10 to the upper edge of the sidewalls. Accordingly, the width of the flange 70 is exclusive of the thickness of the ribs 60 at the level of the upper edge of the sidewalls.

The presence of the flange 70 is particularly useful in that it provides additional strength to the sidewalls in resistance to horizontal stress. Accordingly, increasing the width of the flange 70 is known to be useful for maximizing sidewall stiffness. Increasing the width of the flange 70, however, has the disadvantage of increasing the maximum outer dimension of the tray 10. An overall increase in the outer dimension of the tray 10 is a disadvantage in regard to shipping and display of the case-ready meat product in the tray 10. For example, trays containing case-ready meat products are often shipped in cardboard boxes that are optimized in size to precisely fit a predetermined number of trays. Accordingly, an increase in the overall outer dimensions of the tray would minimize the number of trays with product that could be shipped at a given time. Similarly, an increase in the outer dimensions of the tray would lessen the number of trays with product that could be displayed in a given display case.

These four inter-limiting specifications of horizontal stress resistance, vertical stress resistance, internal tray volume, and outer tray dimension are optimized by the tray of the present invention. This is optimization is achieved through the following aspects of the tray of the present invention: 1) at least one of the sidewalls of the tray has at least a partial lengthwise portion that is bowed inwardly toward the interior of the tray; 2) the width of the flange is variable along the length of the at least one sidewall, preferably being increased in the area corresponding to the bowed portion of the sidewall; and 3) the thickness of the ribs is also variable along the length of at least one sidewall.

The embodiment of FIG. 1 illustrates a tray 10 wherein each of the longitudinal walls 30 are bowed inwardly toward the center of the tray 10. The ribs 60 are present in each of the longitudinal walls 30 and each of the end walls 40. The flange 70 has a variable width being at a maximum near the midpoint 35 of each of the longitudinal walls 30 and being at a minimum near the respective corners 50 at opposite ends of each longitudinal wall 30.

Figure 2:
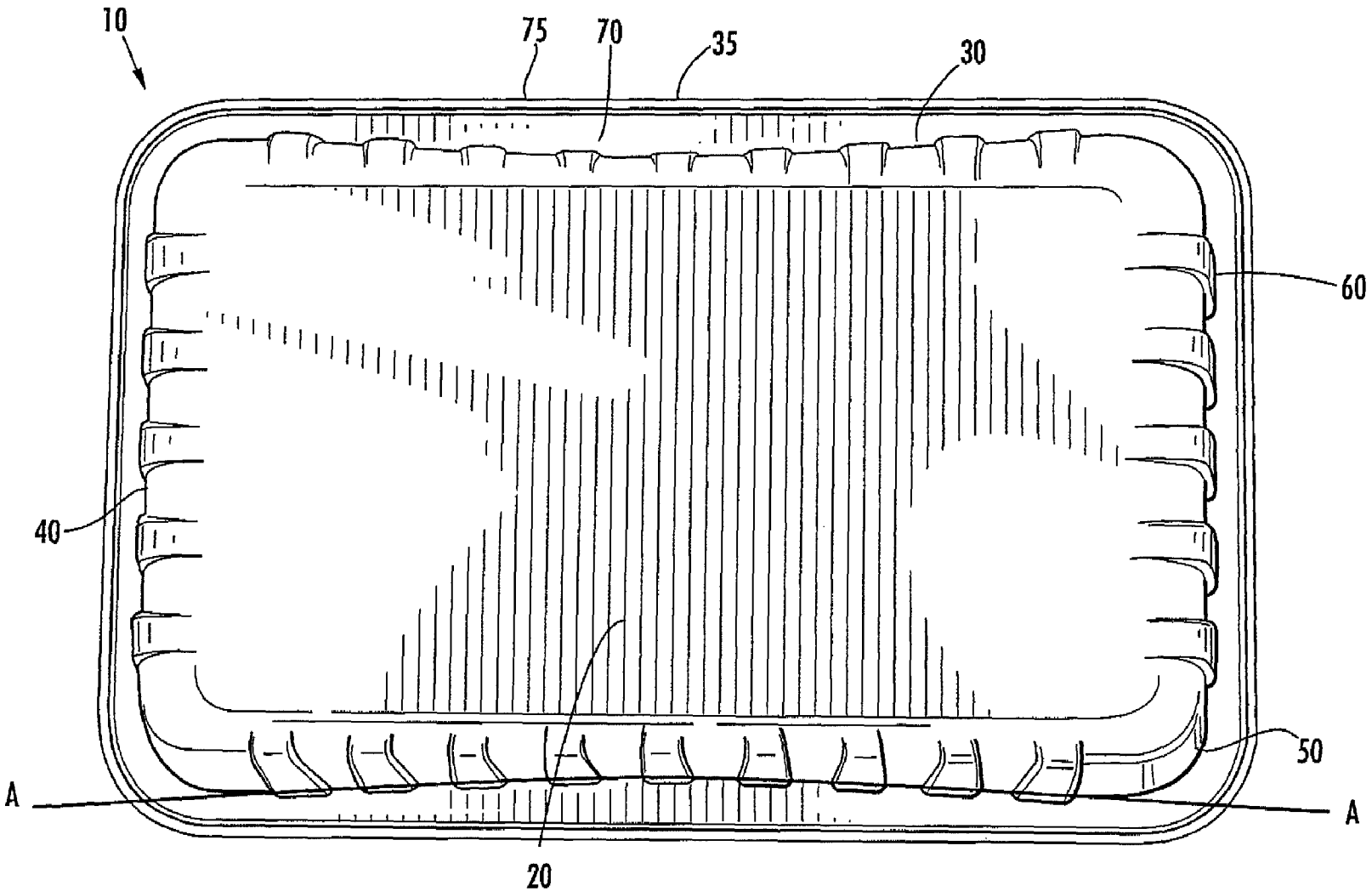
FIG. 2 is a bottom view of one embodiment of the tray of the present invention.

The bowed nature of the longitudinal walls 30 is more clearly illustrated in FIG. 2, which shows a bottom view of one embodiment of the tray 10 according to the present invention. In this embodiment, each of the longitudinal walls 30 is substantially arcuate in shape. This shape is further illustrated by arc A-A in FIG. 2.

As used herein, the term bowed is intended to broadly define a lengthwise portion of a sidewall wherein at least a portion is adjusted inwardly toward the middle of the tray. The arcuate nature of the longitudinal walls 30 in FIG. 2 is but one embodiment of the bowed sidewalls according to the present invention. The term bowed could further describe a sidewall that essentially comprises two linear portions intersecting to form an angular point having an angle $\theta$. The angle $\theta$ is an obtuse angle, preferably being greater than about 160° and less than about 180°, most preferably about 170° to about 175°.

The term bowed further encompasses the embodiment wherein the bowed sidewall portion comprises three substantially linear portions intersecting to form two interior angles. In this embodiment, the first linear portion intersects with the second linear portion to form a first angle. Further, the second linear portion intersects with the third linear portion to form a second angle. The second linear portion is substantially parallel with the outer edge of the flange, and the first and third linear portions project inwardly toward the center of the tray. The angles individually can be the same or different, each angle being less than 180°. Preferentially, the angles are identical. Additionally, similar embodiments are also encompassed by the present invention, and the term bowed is not intended to be limited to the specific embodiments illustrated herein.

In addition to the sidewalls being bowed over at least a portion of at least one of the sidewalls, the flange 70 is also varied in width along the length of at least one of the sidewalls. The variation in width of the flange 70 can be independent of the bowed nature of the sidewalls; however, in a preferred embodiment, the width of the flange 70 is at a maximum at the portion of the sidewall that corresponds to the portion of the sidewall that is maximally bowed. Referring to FIG. 2, each of the longitudinal walls 30 are bowed such that they are substantially arcuate in shape. According to this arcuate shape, the longitudinal walls 30 are maximally adjusted toward the center of the tray 10 at a portion of the length of the longitudinal walls 30 that substantially corresponds to a midpoint 35 of the longitudinal walls 30. The width of the flange 70 along the length of the longitudinal walls 30 varies such that the width is at a minimum at areas of the longitudinal walls 30 near the respective corners 50 at each end of each longitudinal wall 30 and is at a maximum at the area corresponding to a midpoint 35 of each longitudinal wall 30.

In a preferred embodiment, the width of the flange 70 naturally increases as the sidewall to which the flange 70 is integrally attached is bowed inward. Since the outer edge 75 of the flange 70 remains linear along the length of each sidewall, the increased width of the flange 70 is essentially an inward increase to maintain the integral connection with the upper edge of the particular sidewall that is bowed inwardly. Thus, in one embodiment, the variable width of the flange 70 can be characterized as increasing in proportion to the amount the given sidewall is bowed inwardly.

As noted previously, the presence of the flange 70 increases sidewall stiffness in regard to resistance to horizontal stress, thus it is beneficial to increase the width of the flange 70. However, excessive flange width is detrimental in regard to optimization of outer dimensions, as an increase in flange width generally results in the overall width of the flange being increased or the flange being bowed outwardly in a widened portion. The present invention allows for the width of the flange 70 to be increased while the outer edge 75 of the flange 70 remains substantially linear and the overall outer dimensions of the tray 10 remain constant.

The four inter-limiting specifications described earlier are optimized in one respect by balancing the increased sidewall stiffness due to the increased width of the flange 70 with the lost internal volume due to the inward bowing of at least one sidewall. Preferentially, the maximum width of the flange 70 is about 105% to about 125% of the minimum width of the flange 70. In one preferred embodiment, the width of the flange 70 varies from a minimum of about 0.48 inches to a maximum of about 0.60 inches.

The above-stated values are based on a tray of a relatively small size, for example, a standardized tray having a width of 7.17 inches and a length of 11.25 inches. It is therefore understood that for trays of smaller or greater dimensions, the maximum flange width can be correspondingly smaller or greater. For example, in a tray having a length substantially greater than about 12 inches, the maximum width of the flange can be greater than 125% of the minimum width of the flange.

Just as the bowed portion of at least one sidewall of the tray 10 of the invention can be bowed over a partial length of the sidewall, the width of the flange 70 can be at a maximum at either a single point or over a partial length of the sidewall. In one preferred embodiment, the width of the flange 70 is at a maximum over a partial length of at least one sidewall wherein the partial length comprises about 5% to about 50% of the total length of the sidewall, preferentially about 10%. In an especially preferred embodiment, the single point or partial length of the sidewall wherein the width of the flange 70 is maximized substantially corresponds to a midpoint of the sidewall. Further, the width of the flange 70 can be at a maximum at a single point or partial length of the sidewall, or it can be at a maximum at multiple points or multiple partial lengths of the sidewall.

As previously described, the thickness of the ribs (i.e., the distance the rib extend from the sidewall) can be constant, or it can vary along at least a portion of a length of at least one of the sidewalls. Additionally, the variation in thickness of the ribs can be in relation to the variation in width of the flange. Again, this allows for optimization of the four inter-limiting specifications critical to forming a useful tray. For example, in a tray embodiment having two opposite and generally parallel longitudinal walls and two opposite and generally parallel end walls, multiple variations in sidewall bowing, flange width, and rib thickness would be possible. In a particular embodiment, each of the longitudinal walls could be bowed such that they are substantially arcuate over at least a portion of the length of each longitudinal wall with the maximum degree of bowing corresponding to a point along the length of each longitudinal wall that is approximately a midpoint. The flange width can be varied along the length of each longitudinal wall such that the width is at a maximum at a portion of the length thereof corresponding to the midpoint of each longitudinal wall.

With a tray of the above specifications, multiple variations of the ribs can be made to optimize the tray. For example, in one embodiment, the ribs can be present at maximum thickness spaced apart along the length of each of the longitudinal walls and each of the end walls. This provides for a tray having maximum resistance to vertical stress. In a second embodiment, the ribs can be present at maximum thickness spaced apart along the length of each of the end walls but be present in varying thicknesses spaced apart along the length of each of the longitudinal walls. This minimizes the reduction in internal volume while still providing near maximum resistance to vertical stress. In a third embodiment, the ribs can be present at maximum thickness spaced apart along the length of each of the end walls but be present only on the portion of each longitudinal wall near the respective corners. Again, this minimizes the reduction in internal volume while still providing high resistance to vertical stress. Various other embodiments wherein the thickness of the ribs is adjusted are also envisioned by the present invention. In addition to the maximization of resistance to vertical stress and maximization of internal volume, the trays of the embodiments described above also maintain maximum resistance to horizontal stress because of the increased flange width without increasing the overall outer dimensions of the tray because the flange is only widened in areas corresponding to the bowed portions of the sidewalls.

Figure 3:
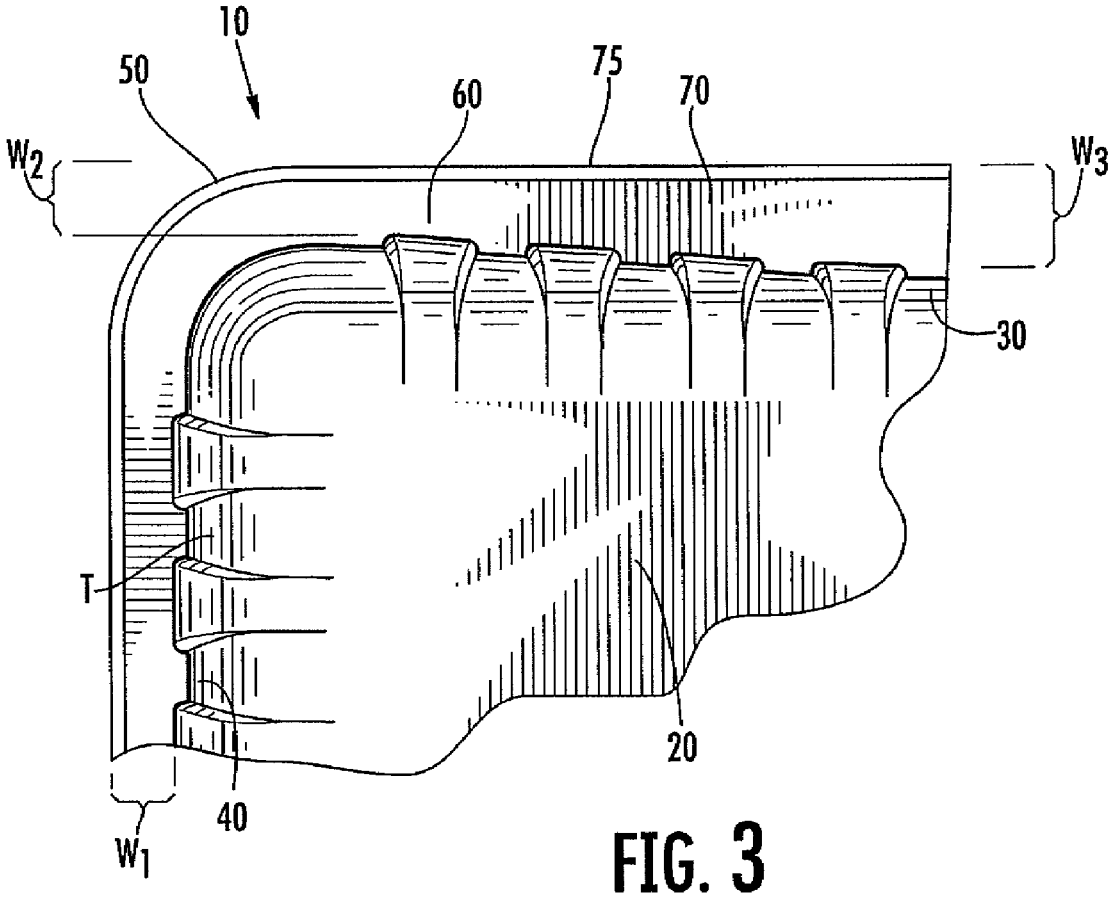
FIG. 3 is a top sectional view of a quarter section of one embodiment of the tray of the present invention.
Figure 4:
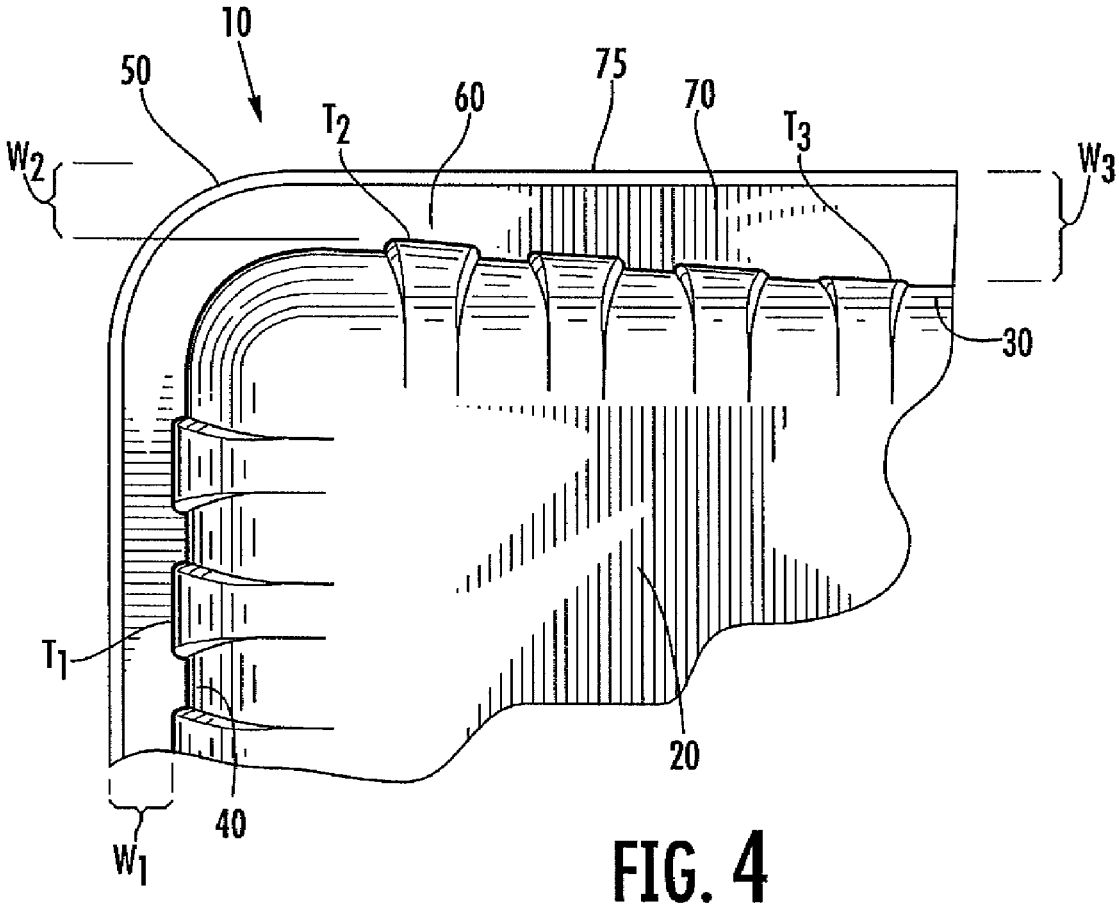
FIG. 4 is a top sectional view of a quarter section of another embodiment of the present invention.

FIG. 3 and FIG. 4 illustrate two particularly preferred embodiments of the present invention. FIG. 3 shows a quarter section of a generally rectangular tray 10 having a base 20. Further visible is one of a pair of longitudinal walls 30 that are generally parallel and situated opposite each other and one of a pair of end walls 40 that are also generally parallel and situated opposite each other. The longitudinal walls 30 and end wall 40 are integrally joined at a corner 50. In FIG. 3, the ribs 60 are spaced apart along the length of the longitudinal walls 30 and the end wall 40. The ribs 60 have a thickness T that is constant along the length of each longitudinal walls 30 and each end wall 40. The flange 70 has a constant width $W_1$ along the length of the end wall 40 and a variable width along the length of the longitudinal wall 30, having a minimum width $W_2$ and a maximum width $W_3$.

Further in reference to FIG. 3, the value of $W_1$ and $W_2$ depends upon the required overall dimensions of the tray. $W_1$ and $W_2$ can be equivalent or can have differing values. In a preferred embodiment, $W_1$ and $W_2$ are equivalent. Once $W_1$ and $W_2$ are known, $W_3$ can be adjusted for tray optimization. Preferentially, $W_3$ has a value in inches that is about 0.05 inches to about 0.125 inches greater than $W_2$. An example of one set of preferred flange widths is as follows: $W_1$=0.498; $W_2$=0.498; and $W_3$=0.586.

While not readily visible in FIG. 3, the width of the flange 70 along the length of the longitudinal walls 30 is variable because at least a portion of the length of the longitudinal walls 30 is bowed inwardly toward the interior of the tray 10. In the embodiment shown in FIG. 3, the longitudinal walls 30 is bowed such that it is maximally bowed in an area corresponding to a midpoint 35 of the longitudinal wall 30. Accordingly, the flange 70 has an increased width in an area corresponding to a midpoint 35 of the longitudinal wall 30. Thus, the width of the flange 70 is increased to provide increased resistance of the longitudinal walls 30 to horizontal stress, but the overall outside dimension of the tray 10 is not increased because the outer edge 75 of the flange 70 remains substantially linear along the length of the longitudinal walls 30 (i.e., the outer edge 75 of the flange 70 is not bowed outwardly in the areas of increased width). While only one longitudinal walls 30 is shown in FIG. 3, preferentially, the opposable longitudinal wall that is not shown is substantially a mirror image in that it is also bowed and has a variable flange width. Similarly, the opposable end wall that is not shown is preferentially substantially a mirror image of the end wall 40 that is shown.

While only the longitudinal walls 30 is bowed in the embodiment of FIG. 3, the present invention is not so limited. For example, in an alternate embodiment, both the longitudinal walls 30 and the end wall 40 could be bowed inwardly and have a variable width of the flange 70. Further, while it is generally envisioned that each longitudinal walls 30 has an overall length that is greater than an overall length of each end wall 40 (thus being generally rectangular in shape), such is not a requirement. For example, each longitudinal walls 30 and each end wall 40 could have an overall length that is substantially equivalent (thus being generally square in shape).

Another preferred embodiment of the present invention is shown in FIG. 4, which illustrates a tray 10 that is substantially similar to the embodiment of FIG. 3 but wherein the ribs 60 are also of varying thickness. According to this embodiment, the ribs 60 have a thickness $T_1$ that describes the thickness of the ribs 60 along the length of the end wall 40, a thickness $T_2$ that describes a maximum thickness of the ribs 60 along the length of the longitudinal wall 30, and a thickness $T_3$ that describes a minimum thickness of the ribs 60 along the length of the longitudinal wall 30.

The values of $T_1$ and $T_2$ can be equivalent, but such equivalence is not required. For example, it may be beneficial for $T_2$ to have a value that is greater than the value of $T_1$ in terms of maximizing resistance of the tray 10 to vertical stress while maximizing the internal volume of the tray 10.

According to the embodiment of the tray 10 of FIG. 4, the thickness $T_1$ of the ribs 60 spaced apart along the length of the end wall 40 is constant along the length of the end wall 40. The maximum thickness $T_2$ of the ribs 60 spaced apart along the length of the longitudinal walls 30 equivalent to the value of $T_1$. The minimum thickness $T_3$ of the ribs 60 spaced apart along the length of the longitudinal walls 30 is about zero. In this embodiment, the ribs 60 are at maximum thickness $T_2$ along the length of the longitudinal walls 30 near the corner 50, and the ribs 60 are at minimum thickness $T_3$ along the length of the longitudinal walls 30 at about a midpoint 35 of the longitudinal wall 30.

Again, variation in thickness of the ribs 60 allows for optimization of the tray 10. For example, in the embodiment of the tray 10 in FIG. 4, the longitudinal walls 30 is bowed inwardly toward the inside of the tray 10 such that the longitudinal walls 30 is maximally bowed at about the midpoint 35 of the longitudinal wall 30. This allows for the width of the flange 70 to be varied along the length of the longitudinal wall 30, particularly being increased toward the midpoint 35 of the longitudinal wall 30, to increase the resistance of the longitudinal walls 30 to horizontal stress. The ribs 60 are present along the length of the end wall 40 and the longitudinal walls 30 to provide increased resistance to vertical stress. The ribs 60, however, have a varied thickness along the length of the longitudinal walls 30 such that the maximum thickness $T_2$ is achieved near the corner 50, and the minimum thickness $T_3$ is achieved near the midpoint 35 of the longitudinal wall 30. This variation in thickness of the ribs 60 maximizes the internal volume of the tray 10.

Variations of the embodiment of FIG. 4 are possible and would be readily evident to one of skill in the art, particularly with the benefit of the present disclosure. For example, in addition to the above, the ribs 60 spaced apart along the length of the end wall 40 could also vary in thickness having a maximum thickness and a minimum thickness. As another example, the variation in thickness of the ribs 60 could be gradual or could be incremental. Further, such incremental variations could be directly from a maximum thickness to a minimum thickness.

As seen in the embodiment of FIG. 4, the variation in thickness of the ribs 60 substantially corresponds to the variation in width of the flange 70, in that the ribs 60 achieve minimum thickness $T_3$ at approximately the same area along the length of the longitudinal walls 30 (i.e., the midpoint 35) that the flange 70 achieves maximum width $W_3$. Such relationship need not be present. Accordingly, generally in regard to the tray of the present invention, there need not be any substantial correlation between flange width and rib thickness. Further, maximum and minimum rib thickness and maximum and minimum flange width can occur at any position along the length of a sidewall of a tray of the invention without regard to the other.

According to the present invention, tray optimization may be benefited through correlation of rib thickness and flange width. In one preferred embodiment, flange width varies inversely with rib thickness such that, along the length of a given sidewall, rib thickness is at a maximum where flange width is at a minimum, and rib thickness is at a minimum where flange width is at a maximum. Preferentially, rib thickness is at a maximum near the respective corners of a given sidewall and gradually decreases along the length of the sidewall achieving a minimum thickness near the midpoint of the sidewall. Meanwhile, along the same length of the same given sidewall, flange width is at a minimum near the respective corners of the sidewall and gradually increased along the length of the sidewall achieving a maximum width near the midpoint of the sidewall. While not required, for purposes of tray optimization, the above-described inverse relationship between rib thickness and flange width can be proportional such that the value of the gradual decrease in rib thickness moving toward the midpoint of the given sidewall is proportionally equivalent to the value of the gradual increase in flange width moving toward the midpoint of the given sidewall. Accordingly, in a preferred embodiment, the tray comprises two opposable sidewalls that are bowed, have a flange of varying width, and have ribs of varying thickness, wherein the width of the flange varies inversely with the thickness of the ribs. It is additionally preferred that the tray further comprises two additional opposable sidewalls that are not bowed and a flange and ribs that do not vary in width and thickness, respectively.

In another aspect of the present invention, the tray can further comprise at least one inner wall that is integrally connected to the base and is further integrally connected, and perpendicular to, two opposable sidewalls. In a particular embodiment, the tray comprises a generally rectangular base, two longitudinal walls and two end walls connected at four corners, a flange integrally connected to and extending outward from an upper edge of the longitudinal walls and the end walls, and a plurality of substantially vertical ribs formed in at least a portion of at least the longitudinal walls. Each of the longitudinal walls is bowed inwardly toward the center of the tray, and the flange along the length of the longitudinal walls is variable in length. The tray further comprises at least one inner wall integrally connected to the base. The at least one inner wall is preferably perpendicular to and integrally connected to each of the longitudinal walls, essentially transecting each longitudinal wall. In a particularly preferred embodiment, the inner wall transects each longitudinal wall at a midpoint of each longitudinal wall essentially dividing the tray into two end sections. Such an inner wall is particularly effective at increasing resistance to horizontal stress in trays having particularly lengthy longitudinal walls. According to this aspect of the invention, the inner wall can have a height that is equal to or less than the height of each longitudinal wall.

The tray according to the present invention is preferentially formed from a sheet of polymer material. Polymers providing lightweight strength and durability are preferred, and the polymer should be safe for use with food products. Accordingly, thermoplastic polymers, such as polypropylene, polystyrene, polyvinyl, polyethylene terephthalate (PET), amorphous polyethylene terephthalate (APET), crystallized polyethylene terephthalate (CPET), and the like are useful for forming trays according to the present invention. Most preferential according to the invention is polypropylene. Furthermore, the polymer material used in the invention can be foamed (understood to mean a polymer material with entrained air) or solid (understood to mean a polymer material with an absence of entrained air).

The tray according to the present invention can also be comprised of a multi-layer construction. In one embodiment, the tray is comprised of essentially three layers, a polypropylene base layer covered by a gas barrier layer, preferentially ethylene vinyl alcohol copolymer (EVOH), which is covered by a polyethylene (PE) sealant layer. Generally, an adhesive is used between each of the three layers. In another embodiment, the tray is comprised of APET covered by a PE sealant layer attached with an adhesive. In yet another embodiment, the tray can be comprised of a foamed polypropylene coated with an EVOH layer and a sealant layer of PE or metallacine PE.

The tray according to the present invention is preferentially used for preparation of a case-ready package for containing meat products, most preferentially ground beef. In order to maintain freshness of the meat product, it is desirable that the internal volume of the tray be sufficient to contain not only the meat product, but also a volume of gas sufficient to maintain freshness and facilitate favorable visual properties for an extended period of time, commonly referred to as shelf live. For a ground beef product, the desired shelf life is about 10-12 days, while the desired shelf life for a whole muscle beef products can be up to about 15 days. Typically, a ground beef package is flushed with a gas comprised of about 80% oxygen and about 20% carbon dioxide. Further, in order to have a desirable gas/product volume ratio, it is necessary for the tray to have in internal volume that is about 180% to about 200% of the volume of the meat product. This provides a head space in the tray sufficient to contain a volume of gas equal to about 80% to 100% of the volume of the meat product. Accordingly, a desirable gas/product volume ratio of about 0.8 is maintained.

EXPERIMENTAL

The present invention is more fully illustrated by the following examples, which are set forth to illustrate the present invention and are not to be construed as limiting thereof. A tray prepared according to the present invention is preferably optimized for shipping and displaying case-ready meat products. Accordingly, the tray of the invention is optimized to have increased sidewall stiffness in relation to resistance to vertical and horizontal stress. Additionally, the tray is optimized to achieve these results without reducing internal volume or increasing external dimensions. The ability of the tray of the invention to achieve these goals is illustrated through comparison of a non-optimized tray with optimized trays according to the invention, wherein the trays have substantially identical outer dimensions. The trays in the comparison are rectangular in shape having two parallel longitudinal walls and two parallel end walls, corners connecting the walls, a flange extending outward from an upper edge of each wall, said flange having an outer edge, and substantially vertical ribs formed in each longitudinal wall and each end wall. The results of Examples 1-6 are provided in Table 1.

Example 1

Non-Optimized Tray

In an example of a non-optimized tray for containing 2.5 pounds of ground beef, the total internal volume of the tray is approximately 2043 cc, which is sufficient for containing the meat product, which has a volume of about 1135 cc (about 454 cc/pound), and for containing a desirable volume of gas for preserving freshness, said desirable volume being about 80% of the meat volume, or about 908 cc. The width of the overall tray, when measured from the outer edge of the flange at the midpoint of each longitudinal wall, is about 7.17 inches. The length of the overall tray, when measured from the outer edge of the flange at the midpoint of each end wall, is about 11.25 inches. The total height of the tray is about 2.11 inches. Such a tray is representative of a standardized tray typically used for case ready meat packaging and is non-optimized according to the present invention, i.e., the sidewalls are all essentially linear, and flange width and rib thickness are not variable.

Example 2

First Optimized Tray

In a first optimized tray, each longitudinal wall is bowed inwardly such that each longitudinal wall essentially comprises two linear portions directed inwardly toward the center of the tray and intersecting at about a midpoint of each longitudinal wall to form an angle θ, which is less than 180°. When bowed in this fashion, a line extending from the respective corners at either end of each longitudinal wall forms a base of a triangle, with the height of the triangle being the maximum distance the longitudinal wall is bowed inwardly. In this example, the maximum distance is 0.05 inches. The flange on each longitudinal wall is varied in width such that the external dimensions of the tray remain unchanged, the flange achieving a maximum width at the midpoint of each longitudinal wall. The increased flange width provides for increased resistance to horizontal stress, while the presence of the ribs provides increased resistance to vertical stress. The internal volume of the tray is decreased by about 16 cc or about 0.78%. Accordingly, the gas/product volume ratio is about 0.786.

Example 3

Second Optimized Tray

In a second optimized tray, the tray is identical to the first optimized tray with the exception that each longitudinal wall is maximally bowed at the midpoint a distance of 0.125 inches. In this example, the longitudinal walls again have increased resistance to horizontal stress, vertical stress resistance is still maximized, and the outer dimensions of the tray are still unchanged. The internal volume in this example has been reduced by about 44 cc or about 2.15%. Accordingly, the gas/product volume ratio is about 0.761.

Example 4

Third Optimized Tray

In a third optimized tray, the longitudinal walls are bowed, and the thickness of the ribs is gradually reduced moving from the ends of each longitudinal wall near the respective corners toward the midpoint of each longitudinal wall. Accordingly, the thickness of the ribs is at a maximum near the respective corners and is reduced to zero at the midpoint of each of the longitudinal walls. In this example, the longitudinal walls again have increased resistance to horizontal stress, vertical stress resistance is maintained by the presence of the ribs in each of the end walls and about one half of the length of each of the longitudinal walls, and the outer dimensions of the tray are still unchanged. The internal volume in this example has been reduced by about 8 cc or about 0.39%. Accordingly, the gas/product volume ratio is about 0.793. The tray in this example is comparable to the tray in the first example in that the resistance to horizontal stress by the longitudinal walls in each tray is substantially similar, but the loss in internal volume in this tray is about ¼ the loss in internal volume in the tray of the first example.

TABLE 1

| Example | Distance Flange Width Maximally Increased | Internal Volume | Percent Internal Volume Lost | Gas/ Product Ratio |
|---|---|---|---|---|
| No. 1 (non-optimized) | 0 | 2043 cc | NA | 0.800 |
| No. 2 (optimized tray) | 0.05 | 2027 | 0.78% | 0.786 |
| No. 3 (optimized tray) | 0.125 | 1999 | 2.15% | 0.761 |
| No. 4 (optimized tray) | 0.05 | 2035 | 0.39% | 0.793 |

As noted in each of the examples above, the increased flange width results in increased resistance to horizontal stress. This increased resistance is illustrated in the following example.

Example 5

Increased Sidewall Resistance to Horizontal Stress

To demonstrate the effectiveness of the present in increasing the strength of the tray sidewalls with respect to resistance to horizontal stress, a computer generated finite element analysis was conducted on the non-optimized tray of Example 1 and the optimized tray of Example 6. A three-dimensional model of the trays was generated, and a simulated load of 0.35 pounds per linear inch of tray flange was applied to the flange area of each tray. Such a load represents the force applied to the same area of the tray by the lidding film after the film has been applied and shrinks to final size. With the same force applied to each tray, the optimized tray of Example 6 had an inward deflection of 0.120 inches, or about 30% less than the inward deflection of the non-optimized tray of Example 1 (0.1709 inches).

Example 6

Increased Sidewall Resistance to Horizontal Stress

To further demonstrate the effectiveness of the invention, a non-optimized tray was made according to Example 1, and an optimized tray was made according to Example 6. Each tray was made from polypropylene that was laminated to a coextruded sealant film comprised of a layer of EVOH and a layer of PE, with adhesive between each of the three layers. The trays were subjected to a point load in the horizontal direction at a midpoint along the length of a longitudinal wall of each tray. The load was gradually increased until the tray flange had deflected inward a distance of 0.250 inches. The non-optimized tray of Example 1 was deflected inward a distance of 0.250 inches after a load of 0.98 pounds was applied. The optimized tray of Example 6 deflected inward a distance of 0.250 inches after a load of 1.90 pounds was applied. Accordingly, the performance of the optimized tray indicates the optimized tray of the invention is approximately has about 50% greater resistance to horizontal stress than the non-optimized tray that is common among the industry.

Many modifications and other embodiments of the inventions set forth herein will come to mind to one skilled in the art to which these inventions pertain having the benefit of the teaching presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A tray for case-ready meat products comprising:

a base defining a bottom portion of said tray;

a plurality of sidewalls extending upward a distance from said base, said sidewalls each having an inner surface, an outer surface, and an upper edge, at least one of said sidewalls having a lengthwise portion thereof that is bowed inwardly toward an interior of said tray;

a plurality of corners extending upward from said base, wherein each of said corners is disposed between, and integrally connected to, two of said sidewalls;

a flange integrally connected to, and extending outward from, said upper edge of said sidewalls, said flange having an upper surface, a lower surface, and an outer edge, said outer edge being substantially linear between said corners and defining a maximum outer dimension of said tray, wherein the distance across said upper surface of said flange between said inner surface of said sidewalls and said outer edge of said flange defines a width of said flange, said width varying along a length of at least one of said sidewalls; and a plurality of substantially vertical ribs formed in at least a portion of at least one of said sidewalls and spaced apart therealong, said ribs extending a distance inwardly from said inner surface of said sidewalls, said distance defining a thickness of said ribs, wherein said thickness of said ribs varies along a length of said at least one sidewall.

2. The tray of claim 1, wherein said width of said flange is at a maximum at a midpoint of said at least one sidewall.

3. The tray of claim 1, wherein said width of said flange is at a minimum near said corners of said tray.

4. The tray of claim 1, wherein said thickness of said ribs is at a maximum near said corners of said tray.

5. The tray of claim 1, wherein said thickness of said ribs is at a minimum at a midpoint of said at least one sidewall.

6. The tray of claim 1, wherein said width of said flange varies inversely with said thickness of said ribs.

7. The tray of claim 6, wherein said variation of said width of said flange and said thickness of said ribs is proportional.

8. The tray of claim 1, wherein the width of said flange varies from a maximum of about 0.600 inches to a minimum of about 0.48 inches.

9. The tray of claim 1, wherein the thickness of said ribs varies up to a maximum of about 0.15 inches.

10. The tray of claim 1, wherein said flange has a maximum width and a minimum width, wherein said maximum width of said flange is about 105% to about 125% of said minimum width of said flange.

11. The tray of claim 10, wherein said width of said flange is at a maximum at a single point on at least one of said sidewalls.

12. The tray of claim 10, wherein said width of said flange is at a maximum at a plurality of points on at least one of said sidewalls.

13. The tray of claim 10, wherein said width of said flange is at a maximum over a partial length of at least one of said sidewalls.

14. The tray of claim 13, wherein said partial length of at least one of said sidewalls comprises about 5% to about 50% of a total length of said at least one sidewall.

15. The tray of claim 13, wherein said partial length of at least one of said sidewalls comprises about 10% of a total length of said at least one sidewall.

16. The tray of claim 1, wherein said ribs are present only in a portion of said sidewalls near said corners of said tray.

17. The tray of claim 1, wherein said tray is comprised of a polymer material selected from the group consisting of polyethylene, polypropylene, polystyrene, polyvinyl, PET, APET, CPET, and copolymers of polyethylene and polypropylene.

18. The tray of claim 17, wherein said tray is comprised of polypropylene.

19. The tray of claim 17, further comprising a barrier layer and a sealant layer.

20. The tray of claim 1, wherein said bowed portion of said at least one sidewall is substantially arcuate.

21. The tray of claim 1, wherein said bowed portion of said at least one sidewall forms an angular point having an angle θ.

22. The tray of claim 21, wherein said angle θ is greater than about 160° and less than about 180°.

23. A tray for case-ready meat products comprising:

a polymer sheet material shaped to form a generally rectangular base and four integrally connected sidewalls upstanding from an outer periphery of said base, said sidewalls comprising two opposite generally parallel longitudinal walls and two opposite generally parallel end walls and being integrally joined at four corners of said tray, each of said sidewalls having an upper edge and a flange integrally joined to said upper edges of said sidewalls and extending outwardly therefrom, said flange having an outer free edge;

each longitudinal wall having at least one partial lengthwise portion thereof that is bowed inwardly toward an interior of said tray;

said flange having a varying width along each longitudinal wall, wherein said outer edge of said flange along each longitudinal wall is substantially linear; and a plurality of substantially vertical ribs formed in at least a portion of at least each longitudinal wall and spaced apart therealong, wherein said ribs extend a distance inwardly from each longitudinal wall, said distance varying along a length of each longitudinal wall.

24. The tray of claim 23, wherein said distance is at a maximum near the respective corners at opposite ends of each longitudinal wall.

25. The tray of claim 23, wherein said distance is at a minimum at said midpoint of each longitudinal wall.

26. The tray of claim 23, wherein said ribs are present only in a portion of each longitudinal wall near said corners.

27. The tray of claim 23, wherein said width of said flange is at a maximum at a midpoint of each longitudinal wall.

28. The tray of claim 23, wherein said width of said flange is at a minimum near the respective corners at opposite ends of each longitudinal wall.

29. The tray of claim 23, wherein said flange has a maximum width and a minimum width, said maximum width of said flange being about 105% to about 125% of said minimum width of said flange.

30. The tray of claim 29, wherein said width of said flange is at a maximum at a single point on each longitudinal wall.

31. The tray of claim 29, wherein said width of said flange is at a maximum at a plurality of points on each longitudinal wall.

32. The tray of claim 29, wherein said width of said flange is at a maximum over a partial length of each longitudinal wall.

33. The tray of claim 23, wherein said polymer sheet is comprised of a polymer selected from the group consisting of polyethylene, polypropylene, polystyrene, polyvinyl, PET, APET, CPET, and copolymers of polyethylene and polypropylene.

34. The tray of claim 33, wherein said polymer is polypropylene.

35. The tray of claim 23, wherein said bowed portion of each longitudinal wall is substantially arcuate.

36. The tray of claim 23, wherein said bowed portion of each longitudinal wall forms an angular point having an angle θ.

37. The tray of claim 36, wherein said angle θ is greater than about 160° and less than 180°.

38. A tray for case-ready meat products comprising:

a generally rectangular base defining a bottom portion of said tray;

four integrally connected sidewalls extending upward from an outer periphery of said base, said sidewalls having an inner surface, an outer surface, and an upper edge, and said sidewalls being integrally joined at four corners extending upward from said base;

a flange integrally connected to, and extending outwardly from, said upper edges of said sidewalls and having a free outer edge, said flange varying in width along the lengthwise portion between the respective corners of at least one of said sidewalls, said outer edge of said flange being substantially linear; and a plurality of substantially vertical ribs formed in at least a portion of each of said sidewalls and spaced apart therealong, said ribs extending a distance inwardly from said inner surface of said sidewalls, said distance defining a thickness of said ribs, wherein said thickness of said ribs varies along a length of each longitudinal wall;

wherein at least one of said sidewalls has at least a partial lengthwise portion thereof that is bowed inwardly toward an interior of said tray.

39. The tray of claim 38, wherein said sidewalls further comprise two opposite generally parallel longitudinal walls and two opposite generally parallel end walls.

40. The tray of claim 39, wherein each of said longitudinal walls have at least a partial lengthwise portion thereof that is bowed inwardly toward an interior of said tray.

41. The tray of claim 39, wherein said bowed portion of each of said longitudinal walls is substantially arcuate.

42. The tray of claim 39, wherein said bowed portion of each of said longitudinal walls forms an angular point having an angle $\theta$.

43. The tray of claim 42, wherein said angle $\theta$ is greater than about 160° and less than about 180°.

44. The tray of claim 38, wherein said flange has a maximum width and a minimum width, said maximum width of said flange being about 105% to about 125% of said minimum width of said flange.

45. The tray of claim 39, wherein said width of said flange is at a maximum at a midpoint of each longitudinal wall.

46. The tray of claim 39, wherein said width of said flange is at a minimum near the respective corners at opposite ends of each longitudinal wall.

47. The tray of claim 38, wherein said thickness is at a maximum near the respective corners at opposite ends of each longitudinal wall.

48. The tray of claim 38, wherein said distance is at a minimum at said midpoint of each longitudinal wall.

49. The tray of claim 38, wherein said tray is comprised of a polymer material.

50. The tray of claim 49, wherein said polymer material is selected from the group consisting of polyethylene, polypropylene, polystyrene, polyvinyl, PET, APET, CPET, and copolymers of polyethylene and polypropylene.

51. The tray of claim 50, wherein said tray is comprised of polypropylene.

52. The tray of claim 50, further comprising a barrier layer and a sealant layer.

53. A tray for case-ready meat products comprising:

a polymer sheet material shaped to form a generally rectangular base and four integrally connected sidewalls upstanding from an outer periphery of said base, said sidewalls comprising two opposite generally parallel longitudinal walls and two opposite generally parallel end walls and being integrally joined at four corners of said tray, each of said sidewalls having an upper edge and a flange integrally joined to said upper edges of said sidewalls and extending outwardly therefrom, said flange having an outer free edge;

each longitudinal wall having at least a partial lengthwise portion thereof that is bowed inwardly toward an interior of said tray;

said flange along each longitudinal wall having a width that varies from a maximum at a midpoint of each longitudinal wall to a minimum at the respective corners at opposite ends of each longitudinal wall, wherein said outer edge of said flange along each longitudinal wall is substantially linear; and a plurality of substantially vertical ribs formed in at least a portion of each of said sidewalls and spaced apart therealong, said ribs extending a distance inwardly from said sidewalls, wherein said distance said ribs extend inwardly from said sidewalls varies along a length of said sidewalls.

54. The tray of claim 53, wherein said ribs are present only in a portion of said sidewalls near said corners.

55. The tray of claim 53, wherein said distance said ribs extends inwardly from each of said longitudinal walls is at a maximum near the respective corners at opposite ends of each longitudinal wall and is at a minimum at a midpoint of each longitudinal wall.

56. The tray of claim 53, wherein said polymer is selected from the group consisting of polyethylene, polypropylene, polystyrene, polyvinyl, PET, APET, CPET, and copolymers of polyethylene and polypropylene.

57. The tray of claim 56, wherein said polymer is polypropylene.

* * * * *

UNITED STATES PATENT AND TRADEMARK OFFICE

CERTIFICATE OF CORRECTION

PATENT NO. : 7,857,160 B2
APPLICATION NO. : 10/857268
DATED : December 28, 2010
INVENTOR(S) : Owensby It is certified that error appears in the above-identified patent and that said Letters Patent is hereby corrected as shown below:

Column 8

Line 57, “walls” should read --wall--

Line 60, “walls” should read --wall--

Line 61, “walls” should read --wall--

Column 9

Line 9, “walls” should read --wall--

Line 11, “walls” should read --wall--

Line 12, “walls” should read --wall--

Line 18, “walls” should read --wall--

Line 21, “walls” should read --wall--

Line 25, “walls” should read --wall--

Line 31, “walls” should read --wall--

Line 34, “walls” should read --wall--

Line 36, “walls” should read --wall--

Line 39, “walls” should read --wall--

Line 64, “walls” should read --wall--

Line 65, “walls” should read --wall--

Line 67, “walls” should read --wall--

Column 10

Line 2, “walls” should read --wall--

Line 6, “walls” should read --wall--

Signed and Sealed this
Twentieth Day of March, 2012

David J. Kappos

David J. Kappos
*Director of the United States Patent and Trademark Office*

Line 13, “walls” should read --wall--

Line 14, “walls” should read --wall--

Line 17, “walls” should read --wall--

Line 36, “walls” should read --wall--